US005942011A

United States Patent [19]

Shirasaki et al.

[11] Patent Number: 5,942,011

[45] Date of Patent: Aug. 24, 1999

[54] PROCESS FOR DYEING TEXTILES CONTAINING POLYESTER FIBERS AND DYEING AUXILIARIES

[75] Inventors: Yasuo Shirasaki; Eiichi Ogawa; Yoshikazu Aizawa; Shigemitsu Yabe, all of Saitama-ken, Japan

[73] Assignee: Nippon Kayaku Co., Ltd., Tokyo, Japan

[21] Appl. No.: 09/011,146

[22] PCT Filed: Jun. 9, 1997

[86] PCT No.: PCT/JP97/01961

§ 371 Date: Feb. 2, 1998

§ 102(e) Date: Feb. 2, 1998

[87] PCT Pub. No.: WO97/46752

PCT Pub. Date: Dec. 11, 1997

[30] Foreign Application Priority Data

Apr. 10, 1997 [JP] Japan ..... 9-106806
Jun. 7, 1999 [JP] Japan ..... 8-166625

[51] Int. Cl.[6] ..... D06P 1/62; D06P 3/54

[52] U.S. Cl. ..... 8/590; 8/591; 8/922

[58] Field of Search ..... 8/532, 590, 591, 8/922

[56] References Cited

U.S. PATENT DOCUMENTS 3,679,350 7/1972 Lowenfeld et al. ..... 8/21 C
3,803,837 4/1974 Bohnert et al. .
5,019,133 5/1991 Himeno et al. ..... 8/531
5,294,231 3/1994 Palacin ..... 8/532
5,803,930 9/1998 Russ et al. .

FOREIGN PATENT DOCUMENTS 48-96881 12/1973 Japan .
59-168193 9/1984 Japan .
1-314790 12/1989 Japan .
2-229283 9/1990 Japan .

*Primary Examiner*—Margaret Einsmann
*Attorney, Agent, or Firm*—Nields, Lemack & Dingman

[57] ABSTRACT

This invention relates to a method of dyeing fibers containing polyester fibers characterized by their exhaustion dyeing in an alkaline aqueous medium, and a dyeing assistant for fibers containing polyester fibers which is effective for carrying out the dyeing method, and which is characterized by containing a compound represented by formula (I)

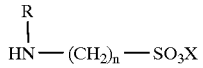

(where R is H or CH3, n is 1 to 3, and X is H, an alkali metal, or an organic base).

Moreover, this invention relates to a dyed product of fibers containing polyester fibers as dyed by the method mentioned above.

6 Claims, No Drawings

PROCESS FOR DYEING TEXTILES CONTAINING POLYESTER FIBERS AND DYEING AUXILIARIES

TECHNICAL FIELD

This invention relates to a dyeing method which enables the exhaustion dyeing of fibers containing polyester fibers with a disperse dye in an alkaline aqueous medium to be carried out with high reproducibility by preventing the decomposition of the disperse dye, and moreover, a dyeing method which enables the one-bath exhaustion dyeing of a mixture of polyester and cellulose fibers with a disperse dye and a metal complex type direct dye in an alkaline aqueous medium to be carried out with high reproducibility by preventing the decomposition of the disperse dye and without having any adverse effect on the direct dye, as well as dyeing assistants which are effective for carrying out those dyeing methods.

BACKGROUND ART

The dyeing of polyester fibers is usually carried out by using a disperse dye in an acidic dye bath (having a pH of 4 to 6) at a temperature of 120–140° C. The disperse dye is unstable in an alkaline dye bath, and its use in an alkaline dye bath makes it difficult to achieve a high reproducibility of dyeing with the same color-shade.

There has, however, arisen recently a new technical demand for the dyeing of polyester fibers in an alkaline bath having a pH of 8 to 10. It is based on the desire to obtain dyed products without having any seriously impaired reproducibility of dyeing even if any alkaline substance used for scouring or weight reduction prior to dyeing may be carried forward into a dye bath as a result of e.g. insufficient washing and make it alkaline, and the advantages of an alkaline dye bath, which dissolve any olygomer (a low-molecular component present in polyester fibers) remaining on cloth passed to the dyeing process, thereby preventing any trouble caused by coarse particles of any olygomer remaining after filtration during, for example, cheese dyeing, while the alkaline dye bath also makes it possible to prevent any coagulation of the dye, and remaining size, and thereby decrease the contamination of a can holding it.

There has also arisen recently a new technical demand for the one-bath dyeing of a mixture of polyester and cellulose fibers, particularly of polyester and rayon fibers, with a disperse dye and a metal complex type direct dye in an alkaline bath having a pH of 8 to 10. While it has also been usual to carry out the dyeing of a mixture of polyester and cellulose fibers in an acidic dye bath (having a pH of 4 to 6) at a temperature of 120–140° C., the advantages of their dyeing in an alkaline bath include not only the advantages as stated above of the dyeing of polyester fibers in an alkaline bath, but also an improved degree of level dyeing, as the alkaline bath restrains the initial absorption of the direct dye, an improved feeling of the mixed polyester and rayon fibers as dyed, etc.

The use of an amino acid, or a derivative thereof has been proposed to prevent the decomposition of a disperse dye used for the absorption dyeing of polyester fibers, or fibers containing polyester fibers in an alkaline bath (Japanese Patent Publications Nos. Hei 7-53952 and Hei 7-18093). The use of an amino acid, or a derivative thereof, however, cannot be said to be satisfactorily effective for preventing the decomposition of a disperse dye, though it may certainly be effective to some extent or other. Moreover, the amino acids have the drawback of being difficult to use for the one-bath absorption dyeing of mixed polyester and cellulose fibers with a disperse dye and a metal complex type direct dye in an alkaline bath, since they hinder the exhaustion of the direct dye, or bring about a change of its hue.

Under these circumstances, there has been a desire to establish a dyeing method which enables the exhaustion dyeing of fibers containing polyester fibers with a disperse dye in an alkaline aqueous medium to be carried out with high reproducibility by preventing the decomposition of the disperse dye, and moreover, a dyeing method which enables the one-bath exhaustion dyeing of a mixture of polyester and cellulose fibers with a disperse dye and a metal complex type direct dye in an alkaline aqueous medium to be carried out with high reproducibility by preventing the decomposition of the disperse dye and without having any adverse effect on the direct dye.

We, the inventors of this invention, have made a great deal of study to solve the problems of the prior art as stated above, and arrived at this invention.

DISCLOSURE OF THE INVENTION

Thus, this invention resides in:

(1) A method of dyeing fibers containing polyester fibers with a disperse dye, characterized by their exhaustion dyeing in an alkaline aqueous medium containing a compound represented by formula (I)

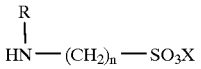

(where R is H or CH3, n is 1 to 3, and X is H, an alkali metal, or an organic base);

(2) A method of dyeing a mixture of polyester and cellulose fibers with a disperse dye and a metal complex direct dye, characterized by their one-bath dyeing in an alkaline aqueous medium containing a compound of formula (I) as set forth at (1) above;

(3) A dyeing method as set forth at (1) or (2) above, wherein the compound represented by formula (I) as set forth at (1) above is taurine;

(4) A dyeing assistant for fibers containing polyester fibers which contains a compound represented by formula (I) as set forth at (1) above;

(5) A dyeing assistant as set forth at (4) above, which is an alkaline aqueous solution containing 2 to 50% by weight of the compound of formula (I) as set forth at (1) above;

(6) A dyeing assistant as set forth at (4) or (5) above, wherein the compound of formula (I) as set forth at (1) above is taurine; and (7) A dyed product of fibers containing polyester fibers as dyed by a method as set forth at any of (1) to (3) above.

BEST MODE OF CARRYING OUT THE INVENTION

The following is a detailed description of this invention.

Description will first be made of the dyeing method according to this invention.

The disperse dye which is used for the purpose of this invention is not particularly limited, but may, for example, be a disperse dye etc. such as an azo disperse dye such as a monoazo or disazo dye, or an anthraquinone having in its structure a substituent group which is easily hydrolyzable in an alkaline condition, such as an acetylamino group, a cyano group substituted in its aromatic ring, or an —OCO—R group (where R is a C1–C3 alkyl, or phenyl group).

In the event that fibers containing polyester fibers are a mixture of polyester and cellulose fibers, a metal complex type direct dye is used with the disperse dye for dyeing the cellulose fibers, and though it is not particularly limited, an azo copper-containing direct dye is preferably used.

The method of this invention for dyeing fibers containing polyester fibers includes two methods, i.e. a method of dyeing polyester fibers and a method of dyeing a mixture of polyester and cellulose fibers in one bath. The dyeing method of this invention is a method of dyeing by exhaustion from an aqueous medium, and employs an alkaline dye bath. The dye bath has a pH of usually 8 to 11, and preferably 8 to 10.

An alkali metal compound, such as sodium hydroxide, potassium hydroxide, sodium carbonate or sodium hydrogen carbonate, or an organic alkaline substance, such as monoethanolamine, diethanolamine or triethanolamine, can usually be employed as a pH controller, but sodium hydroxide, sodium carbonate or diethanolamine is preferable. A combination of two or more substances can be used, too.

According to this invention, it is essential that the alkaline dye bath used for the exhaustion dyeing of fibers containing polyester fibers contain a compound represented by formula (I) as shown above. Specific examples of the compound of formula (I) are taurine, N-methyltaurine and aminomethanesulfonic acid, and preferred one is taurine. The compound represented by formula (I) may be used in the form of a free acid (that is, X is hydrogen), or in the form of a salt. If it is a salt, it is preferably an alkali metal salt, or organic base.

A salt of e.g. sodium, potassium or lithium is preferred as the alkali metal salt. As the organic base, it is preferable to use an ammonium salt represented by formula (II)

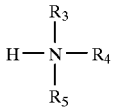

(where R3, R4 and R5 are the same, or different substituent groups selected from the group consisting of hydrogen, a lower alkyl group and a lower hydroxyalkyl group. The lower alkyl or hydroxyalkyl group means a linear or branched chain having 1 to 6 carbon atoms.)

The compound of formula (I) is used in the amount of usually 0.05 to 2 g, and preferably 0.1 to 1 g, per liter of a dye bath.

The dyeing method of this invention is applicable to any of a woven or knitted fabric, or yarn made of polyester fibers or a mixture of polyester and cellulose fibers.

The cellulose fibers include natural cellulose fibers such as cotton and hemp fibers, and regenerated cellulose fibers such as rayon, polynosic and lyocell fibers.

The pH of a dye bath which has been prepared is finally controlled by a pH controller to an alkaline range of usually 8 to 11, and preferably 8 to 10, as stated above (even after the material to be dyed has been added to the bath if it is a material treated for weight reduction), and as the dyeing conditions, it is possible to employ a dyeing temperature of 120 to 140 a dyeing time of 30 to 60 minutes at an elevated pressure as usually applied for dyeing polyester fibers. A bath ratio of 1:10 to 20 is usually employed. The dyeing of a mixture of polyester and cellulose fibers with a disperse dye and a metal complex type direct dye is carried out by adding an inorganic salt, such as sodium sulfate, conducting the same process for the dyeing of polyester fibers as described above, and then, lowering the temperature to 90° C. and continuing their treatment at that temperature for 10 to 20 minutes in order to stabilize the exhaustion of the direct dye, whereby a high reproducibility of dyeing can be attained. The dyeing method of this invention is applicable to either a material treated for weight reduction, or not. The post-treatment in the dyeing process of a mixture of polyester and cellulose fibers is preferably carried out by washing, soaping as required, and fixing. The post-treatment in the dyeing process of fibers consisting solely of polyester fibers may also be carried out by reduction cleaning in an ordinary way.

The dyeing method of this invention may also be followed by other kinds of customary post-treatment given to dyed products, including antistatic finishing and softening.

Description will now be made of the dyeing assistant of this invention.

The dyeing assistant of this invention is an alkaline aqueous solution containing usually 2 to 50% by weight of compound of formula (I) shown before, and preferably having its pH controlled to a range of 8 to 11 by a pH controller as mentioned before (preferably diethanolamine, sodium hydroxide or sodium carbonate). It may also contain a sequestering agent, and a dispersing or leveling agent which is usually employed for the level dyeing of polyester fibers with a disperse dye, if required. It is desirable to start dyeing after adding an appropriate amount of dyeing assistant of this invention to obtain a dye bath containing such an amount of compound of formula (I) as falls within the range stated above, and controlling its pH as stated above, if required.

This invention enables the dyeing of fibers containing polyester fibers in an alkaline bath to be carried out satisfactorily without allowing the decomposition of the disperse dye, or having any adverse effect on the metal complex type direct dye.

The dyeing of these fibrous materials in an alkaline bath provides advantages including an improved degree of dyeing reproducibility, the elimination of various kinds of trouble as caused by olygomers, a decrease in contamination of a can, an improved degree of level dyeing and an improved feeling of a dyed product, over their conventional dyeing in an acidic bath.

The invention will now be described more specifically based on examples embodying it, though these examples are not intended for limiting this invention.

EXAMPLES 1 TO 6 AND COMPARATIVE EXAMPLE 1

Each of powders of C. I. Disperse Orange 30, C. I. Disperse Blue 291 and C.I. Disperse Violet 93:1 was pulverized with a dispersing agent by an ordinary method to form a disperse dye having the dye powder content of 30% by weight, and their disperse dyes were mixed in a ratio of 4:1:2 (by weight) to prepare a disperse dye mixture (a black dye). A dye bath was prepared by using 2% by weight of the disperse dye mixture relative to the material to be dyed, adding a compound of formula (I) in the amount shown in Table 1, adding also 0.4 g of sodium bicarbonate and 0.3 g of soda ash (anhydrous) per liter except in Reference Example 1, and adding a very small amount of hydrochloric acid or caustic soda, so that the bath might have a pH of 9.5. The bath was used at a bath ratio of 1:20 for dyeing a tropical woven polyester fabric at a temperature of 130° C. for 60 minutes. Then, its water washing, and reduction rinsing at 80° C. were done to obtain a dyed fabric.

REFERENCE EXAMPLE 1

A dyed fabric to be used as a standard for evaluation was prepared without using any compound of formula (I), or any alkaline substance, but by adding 0.2 g of acetic acid and 0.6 g of sodium acetate per liter to make a bath having a pH of 5.0 (acidic), and otherwise repeating the process as described above.

Each dyed fabric was evaluated for its results of dyeing by comparison with the dyed fabric as obtained in Reference Example 1 as a standard, and the results are shown in Table 1. Each dyed fabric was evaluated by the methods described below.

Methods of Evaluation

Color difference ΔE: The reflectance of each dyed fabric was measured by a MacBeth spectrophotometer, CE-3100, and its overall color difference ΔE from the dyed fabric of Reference Example 1 was determined from CIE L* a* b*. The larger the value of ΔE is, the larger the color difference shows.

Visual judgment: Visual judgment was made for determining the degree of any difference in hue from Reference Example 1 as a standard.

○-Δ: A very small difference in hue;

Δ: Some difference in hue;

×: A considerable difference in hue.

EXAMPLE 7, COMPARATIVE EXAMPLES 2 AND 3, AND REFERENCE EXAMPLE 2

In Example 7, a dyed fabric was obtained by using 2% by weight, based on the material to be dyed, of a disperse dye containing 30% of a dye powder of C. I. Disperse Blue 281, while preparing a bath having a pH of 9.0, and otherwise repeating Examples 1 to 6. In Comparative Example 3, a dyed fabric was obtained by using a bath having a starting pH of 9 without adding any compound, and in Reference Example 2, a dyed fabric was obtained by using a bath having a starting pH of 5.0 without adding any compound. In Comparative Example 2, a dyed fabric was obtained by adding an amino acid as proposed in Japanese Patent Publication No. Hei 7-53952 instead of the compound of formula (I), and otherwise repeating Example 7.

Each dyed fabric was evaluated for its results of dyeing by comparison with the dyed fabric of Reference Example 2 employed as a standard, and the results are shown in Table 2.

Methods of Evaluation

Color difference ΔE: Reference Example 2 was employed as a standard, and the method as described before for Examples 1 to 6 was otherwise repeated;

Surface density: The reflectance of each dyed fabric was measured by the spectrophotometer, CE-3100, and its Q total value (a value representing surface density) was calculated, and is shown as a relative value against a standard of 100 given to Reference Example 2.

TABLE 1

| No. | Compound of Formula (I) I | Dyeing Conditions g/l | Starting pH of bath | Ending pH of bath | Results of Dyeing Color difference ΔE | Visual evaluation |
|---|---|---|---|---|---|---|
| Example 1 | Taurine | 1.0 | 9.5 | 9.1 | 2.4 | Δ (Somewhat reddish) |
| Example 2 | Taurine | 2.0 | 9.5 | 9.2 | 2.3 | Δ (Somewhat reddish |
| Example 3 | N-methyltaurine | 1.0 | 9.5 | 9.0 | 2.3 | Δ (Somewhat reddish |
| Example 4 | N-methyltaurine | 2.0 | 9.5 | 9.1 | 2.2 | Δ (Somewhat reddish |
| Example 5 | Aminomethane sulfonic acid | 1.0 | 9.5 | 8.7 | 1.1 | ○–Δ (Very slightly reddish) |
| Example 6 | Aminomethane sulfonic acid | 2.0 | 9.5 | 8.6 | 0.9 | ○–Δ (Very slightly reddish) |
| Comparative Example 1 | — | — | 9.5 | 7.6 | 3.2 | X (Considerably reddish) |
| Reference Example 1 | — | — | 5.0 | 4.9 | standard | Standard |

As is obvious from Table 1, Comparative Example 1 in which a bath having a starting pH of 9.5 had been used for dyeing showed a large color difference as a result of the decomposition of the disperse dye as compared with the case in which a bath having a pH of 5.0 had been used as usual for dyeing polyester fibers (Reference Example 1), but Examples 1 to 6 showed a smaller color difference owing to the restrained decomposition of the disperse dye despite the use of a bath having a starting pH of 9.5 and an ending pH which had been higher than that in Comparative Example 1.

Examples 5 and 6 showed the best results apparently owing to the use of aminomethanesulfonic acid having a lower power as a buffer and making the bath have a lower ending pH than when the other compounds had been employed.

TABLE 2

| No. | Compound added I | Dyeing Conditions g/l | Starting pH of bath | Ending pH of bath | Results of Dyeing Color difference ΔE | Surface density |
|---|---|---|---|---|---|---|
| Example 7 | Taurine | 1.0 | 9.0 | 8.9 | 5.9 | 68 |
| Comparative Example 2 | Glycine | 1.0 | 9.0 | 8.9 | 6.6 | 65 |
| Comparative Example 3 | — | — | 9.0 | 7.9 | 15.4 | 38 |

TABLE 2-continued

| No. | Compound added I | Dyeing Conditions g/l | Starting pH of bath | Ending pH of bath | Results of Dyeing Color difference ΔE | Surface density |
|---|---|---|---|---|---|---|
| Reference Example 2 | | — | 5.0 | 4.9 | Standard | 100 (Standard) |

It is obvious from Table 2 that taurine (Example 7) is more effective for preventing the decomposition of the disperse dye than the amino acid (Comparative Example 2) as proposed in Japanese Patent Publication No. Hei 7-53952.

EXAMPLES 8 TO 12

The compounds (reagents) shown in Table 3 were weighted in fixed amount and dissolved in an appropriate amount of ion exchange water under 30 minutes of stirring at room temperature to prepare each 1000 g of a dyeing assistant embodying this invention.

TABLE 3

| Compound | Taurine | A* | $Na_2CO_3$ | NaOH | Di-ethanol-amine | B* | C* | Ion exchange water (g) |
|---|---|---|---|---|---|---|---|---|
| Example 8 | — | 100 | 10 | — | 100 | 1 | — | 789 |
| Example 9 | 80 | — | 30 | — | 80 | — | 50 | 760 |
| Example 10 | — | 80 | — | 10 | 80 | — | — | 830 |
| Example 11 | 70 | — | 20 | — | 80 | — | 100 | 730 |
| Example 12 | 75 | — | — | 20 | 75 | 1 | — | 829 |

A*: N-methyltaurine (a sodium solution containing 65% of N-methyltaurine was used after its pH had been controlled to 7 by adding hydrochloric acid);
B*: Ethylenediaminetetraacetic acid (a sequestering agent);
C*: Aminotrimethylenephosphonic acid (a solution containing 40% of aminotrimethylenephosphonic acid (as a 5-sodium salt) was used as a sequenstering agent).

A*: N-methyltaurine (a sodium solution containing 65% of N-methyltaurine was used after its pH had been controlled to 7 by adding hydrochloric acid);

B*: Ethylenediaminetetraacetic acid (a sequestering agent);

C*: Aminotrimethylenephosphonic acid (a solution containing 40% of aminotrimethylenephosphonic acid (as a 5-sodium salt) was used as a sequestering agent).

EXAMPLE 13

A dye bath having a bath ratio of 1:15 was prepared by employing 0.5% by weight of C. I. Direct Yellow 164 (non-copper complex type), 0.3% by weight of C.I. Direct Red 83:1 (copper complex type) and 0.33% by weight of C. I. Direct Blue 201 (copper complex type) as direct dyes, and 0.15% by weight of C. I. Disperse Yellow 64 (a dispersion prepared by using a dispersing agent in an ordinary way, and having a powder content of 30%), 0.25% by weight of C. I. Disperse Red 60 (ditto) and 0.33% by weight of C. I. Disperse Blue 56 (ditto) as disperse dyes, all based on the weight of the material to be dyed, and 10 g/l of anhydrous sodium sulfate and 2 g/l of dyeing assistant as obtained in Example 12. The bath had a pH of 9.7. A mixture of polyester and rayon fibers (having a weight ratio of 50/50) was put in the dye bath, and was dyed by heating to 130 minutes, holding at that temperature for 60 minutes, lowering the temperature to 90° C. and holding at that temperature for 20 minutes. The bath remaining after dyeing had a pH of 8.3. The dyed product was subjected to 15 minutes of soaping at 40° C. in a bath containing 1 g of a nonionic soaping agent per liter, and was washed, and dried. The dyed product was comparable in depth of shade and hue on both of its polyester and rayon fibers to a product dyed in an acidic bath (having a pH of 5) as usual. The dyed product also had a high degree of level dyeing and a good feeling.

REFERENCE EXAMPLES 3 TO 7

A dye bath was prepared by employing 1.5% by weight, based on the material to be dyed, of a direct dye mixture (a brown dye) obtained by mixing C. I. Direct Yellow 164 (non-copper complex type), C. I. Direct Red83:1 (copper complex type) and C. I. Direct Blue 201 (copper complex type) in a ratio of 1:1:1 (by weight), adding 10 g of anhydrous sodium sulfate per liter, adding a compound (taurine) which the dyeing assistant of this invention contains for Reference Examples 3 and 4, and an amino acid derivative as proposed in Japanese Patent Publication No. Hei 7-18093 (N-methylglycine) for Reference Examples 5 and 6, in the amounts shown in Table 4, except Reference Example 7, adding 0.4 g of sodium bicarbonate and 0.3 g of soda ash (anhydrous) per liter in all of the cases, and thereafter adding a very small amount of hydrochloric acid, or caustic soda to form a bath having a pH of 9.5. A rayon muslin was put in the bath, and dyed at a bath ratio of 1:20 by holding at a dyeing temperature of 130° C. for 60 minutes, lowering the temperature to 90° C. and holding at that temperature for 20 minutes. Then, it was washed to obtain a dyed fabric. Each dyed fabric was evaluated for its results of dyeing by comparison with the dyed fabric of Reference Example 7 employed as a standard, and the results are shown in Table 4.

Results of Evaluation

Reference 7 was employed as a standard, and the methods as described before for Examples 1 to 6 were otherwise repeated. The symbols used to show the results of visual evaluation, however, have the following meanings:

○: Comparable;

Δ: Slightly different in hue;

×: Considerably different in hue;

××: Extremely different in hue.

TABLE 4

| No. | Compound added | Dyeing Conditions g/l | Starting pH of bath | Ending pH of bath | Results of Dyeing Color difference ΔE | Visual evaluation |
|---|---|---|---|---|---|---|
| Reference Example 3 | Taurine | 1.0 | 9.5 | 8.9 | 0.8 | ○ (Comparable) |
| Reference Example 4 | Taurine | 3.0 | 9.5 | 9.1 | 1.1 | Δ (Slightly yellowish) |
| Reference Example 5 | N-methylglycine | 1.0 | 9.5 | 8.8 | 2.1 | X (Considerably yellowish) |
| Reference Example 6 | N-methylglycine | 3.0 | 9.5 | 9.1 | 4.6 | XX (Extremely yellowish) |
| Reference Example 7 | | | 9.5 | 9.1 | Standard | Standard |

It is obvious from Table 4 that, while N-methylglycine (Reference Examples 5 and 6) produces an extreme change of hue by inhibiting the exhaustion of the copper complex type direct dyes, taurine (Reference Examples 3 and 4) hardly exerts any adverse effect on the copper complex type direct dyes.

Industrial Utility

According to this invention, a dye bath containing a specific compound enables the dyeing of polyester fibers, which has hitherto been carried out in an acidic range, to be carried out in an alkaline range with high reproducibility by preventing the decomposition of any disperse dye. Moreover, this invention enables the one-bath dyeing of a mixture of polyester and cellulose fibers with a disperse dye and a metal complex type direct dye in an alkaline range to be carried out with high reproducibility without exerting any adverse effect on the direct dye. Thus, this invention is of great value to the dyeing industry.

What is claimed is:

1. A method of dyeing fibers containing polyester fibers with a disperse dye, characterized by their exhaustion dyeing in an alkaline aqueous medium containing a compound represented by formula (I)

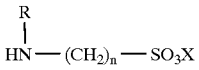

(where R is H or CH3, n is 1 to 3, and X is H, an alkali metal, or an organic base).

2. A method of dyeing a mixture of polyester and cellulose fibers with a disperse dye and a metal complex direct dye, characterized by their one-bath dyeing in an alkaline aqueous medium containing a compound represented by formula (I)

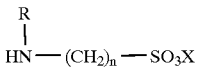

(where R is H or $CH_3$, n is 1 to 3, and X is H, an alkali metal, or an organic base).

3. A dyeing method as set forth in claim 1 or 2, wherein the compound represented by formula (I) is taurine.

4. A dyeing bath comprising a dyeing assistant for exhaustion dyeing of fibers containing polyester fibers which contains a compound represented by formula (I):

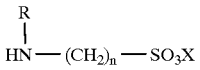

(where R is H or $CH_3$, n is 1 to 3, and X is H, an alkali metal, or an organic base), and a disperse dye.

5. A dyeing bath as set forth in claim 4, wherein said dyeing assistant is an alkaline aqueous solution containing 2 to 50% by weight of the compound of formula (I).

6. A dyeing bath as set forth in claim 4 or 5, wherein the compound of formula (I) is taurine.

* * * * *